US009353716B2

(12) United States Patent
Sato et al.

(10) Patent No.: US 9,353,716 B2
(45) Date of Patent: May 31, 2016

(54) HIGH-PRESSURE FUEL PUMP DEVICE

(75) Inventors: Tomoya Sato, Iwate (JP); Tetsuo Muraji, Odawara (JP); Toshinori Hirayama, Iwate (JP); Hiroshi Kato, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 275 days.

(21) Appl. No.: 14/115,847

(22) PCT Filed: May 11, 2012

(86) PCT No.: PCT/JP2012/062150

§ 371 (c)(1),
(2), (4) Date: Nov. 5, 2013

(87) PCT Pub. No.: WO2012/157564

PCT Pub. Date: Nov. 22, 2012

(65) Prior Publication Data

US 2014/0064989 A1 Mar. 6, 2014

(30) Foreign Application Priority Data

May 13, 2011 (JP) ..... 2011-108096

(51) Int. Cl.
*F02M 59/00* (2006.01)
*F04B 17/03* (2006.01)
(Continued)

(52) U.S. Cl.
CPC ..... *F02M 59/00* (2013.01); *F02M 37/0023* (2013.01); *F02M 37/046* (2013.01);
(Continued)

(58) Field of Classification Search
CPC ..... F04B 17/03; F04B 23/04; F04B 23/06; F04B 43/02; F04B 43/067; F02D 41/3082; F02M 37/08; F02M 37/14; F02M 37/18; F02M 37/046; F02M 37/029; F02M 37/0052; F02M 59/00; F02M 59/46; F02M 59/462; F02M 59/464
USPC ..... 123/497, 506, 511, 514, 446, 457
See application file for complete search history.

(56) References Cited

U.S. PATENT DOCUMENTS 5,190,444 A * 3/1993 Grinsteiner et al. .... F04B 23/08 417/199.1
6,062,830 A * 5/2000 Kikuchi et al. ..... F02M 55/04 417/540
2010/0012096 A1* 1/2010 Kieferle et al. ..... F02M 59/205 123/497

FOREIGN PATENT DOCUMENTS

CN 201265469 Y 7/2009
CN 102197212 A 9/2011
(Continued)

OTHER PUBLICATIONS

International Search Report for PCT/JP2012/062150, mailed Jun. 5, 2012.
(Continued)

*Primary Examiner* — Alexander Comley
*Assistant Examiner* — Chirag Jariwala
(74) *Attorney, Agent, or Firm* — Marshall, Gerstein & Borun LLP

(57) ABSTRACT

A high-pressure fuel pump device of the invention includes a plunger-type high-pressure pump unit (31) configured to pressurize fuel as a plunger (43) thereof makes reciprocating motion, a diaphragm-type supply pump unit (33) configured to suck in fuel in a fuel tank (11) and supply the fuel to the high-pressure pump unit as a diaphragm (87) thereof oscillates in conjunction with the reciprocating motion of the plunger, and a fuel return unit (34) provided in the supply pump unit and configured to return, to the fuel tank, surplus fuel that is not sucked into the high-pressure pump unit.

7 Claims, 10 Drawing Sheets

(51) Int. Cl.

| | |
|---|---|
| ***F04B 23/06*** | (2006.01) |
| ***F04B 53/12*** | (2006.01) |
| ***F02M 39/00*** | (2006.01) |
| ***F02M 59/10*** | (2006.01) |
| ***F04B 9/04*** | (2006.01) |
| ***F04B 43/02*** | (2006.01) |
| ***F04B 43/067*** | (2006.01) |
| ***F02M 63/00*** | (2006.01) |
| ***F02M 37/00*** | (2006.01) |
| ***F02M 59/46*** | (2006.01) |
| ***F02M 37/04*** | (2006.01) |
| *F02B 61/02* | (2006.01) |

(52) U.S. Cl.

CPC ..... *F02M39/005* (2013.01); *F02M 59/102* (2013.01); *F02M 59/46* (2013.01); *F02M 59/462* (2013.01); *F02M 59/464* (2013.01); *F02M 63/005* (2013.01); *F04B 9/042* (2013.01); *F04B 17/03* (2013.01); *F04B 23/06* (2013.01); *F04B 43/021* (2013.01); *F04B 43/067* (2013.01); *F04B 53/12* (2013.01); *F02B 61/02* (2013.01)

(56) References Cited

FOREIGN PATENT DOCUMENTS

| | | | |
|---|---|---|---|
| DE | 10 2008 042075 | A1 | 3/2010 |
| EP | 0117969 | B2 | 1/1994 |
| EP | 1512866 | A2 | 3/2005 |
| JP | 1-119882 | | 8/1989 |
| JP | 07-012029 | | 1/1995 |
| JP | 09-250427 | | 9/1997 |
| JP | 11-350930 | | 12/1999 |

OTHER PUBLICATIONS

Written Opinion for PCT/JP2012/062150, mailed Jun. 5, 2012.

Extended European Search Report from Application No. EP 12785395, dated Sep. 26, 2014.

* cited by examiner

HIGH-PRESSURE FUEL PUMP DEVICE

TECHNICAL FIELD

The present invention relates to a high-pressure fuel pump device for supplying fuel stored in a fuel tank to an injector.

BACKGROUND ART

In two-wheeled motor vehicles, namely, in motorcycles, a fuel injection system using an injector to inject fuel has come to be widely used in place of carburetor. In such fuel injection systems, fuel pressurized by means of a plunger-type high-pressure fuel pump device is supplied to the injector attached to the engine.

Since the plunger-type high-pressure fuel pump device is configured to increase the pressure of fuel for delivery by moving the plunger, however, it cannot be expected to perform the function of sucking up fuel stored in the fuel tank. Thus, in motorcycles, the plunger-type high-pressure fuel pump device is located at a lower level than the fuel tank so as to utilize the weight of fuel to suck in the fuel, or is arranged within the fuel tank to directly suck in the fuel stored in the fuel tank.

In motorcycles in particular, many devices such as the fuel tank, engine and transmission are densely arranged in a limited space surrounded by the front wheel, the fuel tank, the rear wheel and the seat, and therefore, the high-pressure fuel pump device, which is single in number and thus is easier to secure a space for fitting, is used to supply fuel stored in the fuel tank to the injector.

With the recent diversification of motorcycles, the high-pressure fuel pump device also is required to cope with such diversification and sometimes needs to be mounted at a location near the fuel tank or the engine where the high-pressure pipe can be shortened in length.

However, the high-pressure fuel pump device cannot be expected to perform the function of sucking up fuel stored in the fuel tank as stated above, and thus it is often the case that the high-pressure fuel pump device cannot be mounted on motorcycles.

In four-wheeled motor vehicles (automobiles), a feed pump device is provided separately from the high-pressure fuel pump device to suck up fuel stored in the fuel tank, and the fuel is supplied from the feed pump device to the high-pressure fuel pump device, as disclosed in Patent Document 1. In such four-wheeled motor vehicles, to avoid heat damage, the feed pump device is usually arranged within the fuel tank to be cooled by the fuel in the fuel tank, and the fuel is supplied to the high-pressure fuel pump device while suppressing vaporization of the fuel. This configuration could be applied to motorcycles as well.

CITATION LIST

Patent Literature

Patent Document 1: Unexamined Japanese Patent Publication No. 7-12029

SUMMARY OF INVENTION

Technical Problem

However, in the case of motorcycles, the space for outfit is very limited, unlike four-wheeled motor vehicles, and since the fuel tank, engine, injector and transmission are densely arranged in the limited space, it is difficult to secure a space for installing both the high-pressure fuel pump device and the feed pump device (two pump devices). Since the high-pressure fuel pump device and the feed pump device are driven by respective different drive sources in particular, a space for fitting the drive sources is required, and in addition, the feed pump device needs to be immersed in fuel for suppressing vaporization of the fuel. Thus, in the case of motorcycles in which only a limited space is available for outfitting, it is difficult to mount the two devices, namely, the high-pressure fuel pump device and the feed pump device, at respective different locations that may vary depending on the model of motorcycle.

Even if both of the high-pressure fuel pump device and the feed pump device could be fitted, it is highly possible that the fuel passage connecting the feed pump device and the high-pressure fuel pump device is located in the vicinity of the engine, and since the fuel being delivered is liable to vaporize, it is difficult to supply fuel in a stable manner.

An object of the present invention is to provide a high-pressure fuel pump device which is a single compact device enhanced in outfitting flexibility and capable of suppressing vaporization of fuel and which can perform a series of operations from the suction of fuel stored in a fuel tank through to the supply of high-pressure fuel to an injector.

Solution to Problem

To achieve the object, the present invention provides a high-pressure fuel pump device comprising: a plunger-type high-pressure pump unit including a plunger driven by a drive source, the high-pressure pump unit being configured to pressurize fuel and discharge the pressurized fuel as the plunger makes reciprocating motion; a diaphragm-type supply pump unit including a diaphragm capable of oscillating in conjunction with the reciprocating motion of the plunger, the supply pump unit being configured to suck in fuel in a fuel tank and supply the fuel to the high-pressure pump unit as the diaphragm oscillates; and a fuel return unit provided in the supply pump unit and configured such that, out of the fuel supplied to the high-pressure pump unit, surplus fuel that is not sucked into the high-pressure pump unit is returned to the fuel tank by the fuel return unit (claim 1).

Preferably, the diaphragm of the supply pump unit is coupled to the drive source through an actuator shaft, and the plunger of the high-pressure pump unit and the actuator shaft of the diaphragm are arranged coaxially with each other (claim 2). Also, preferably, the plunger of the high-pressure pump unit has a passage formed therein, and the supply pump unit is configured to guide the fuel to the high-pressure pump unit through the passage (claim 3).

Further, the fuel return unit preferably includes a return path configured to pass the fuel to be returned, and a return valve arranged in the return path and configured to flow surplus fuel that is not sucked into the high-pressure pump unit (claim 4).

Preferably, the high-pressure pump unit and the supply pump unit are arranged on one side of the diaphragm, and the drive source is arranged on an opposite side of the diaphragm (claim 5).

Advantageous Effects of Invention

According to the present invention, the high-pressure fuel pump device has a compact structure in which the high-pressure pump unit and the supply pump unit are integrated and share a single drive source, a structure in which the supply pump unit and the high-pressure pump unit are located close to each other to suppress heat damage attributable to heat from the engine, and a structure permitting vapor contained in the fuel to be returned to the fuel tank (claim 1).

With the high-pressure fuel pump device, therefore, a series of operations from the suction of fuel stored in the fuel tank through to the supply of high-pressure fuel to the injector can be stably performed by a single device which is compact in size and has enhanced outfitting flexibility. Moreover, fuel vapor, if generated in the process of delivery to the high-pressure pump unit, is returned together with surplus fuel to the fuel tank. Accordingly, the high-pressure fuel pump device can be installed at a desired location of a motorcycle as in the vicinity of the engine, fuel tank or other component parts, without regard to vaporization of fuel, and thus is best suited for use in motorcycles with many constraints.

The plunger of the high-pressure pump unit and the actuator shaft of the diaphragm are arranged coaxially with each other, and accordingly, the two pump units can be driven by a single drive source, making it possible to reduce the number of component parts as well as cost and to save space (claim 2).

The interior of the plunger is less affected by heat from outside (engine and the like), and the high-pressure fuel pump device is configured such that fuel passes through the interior of the plunger, whereby fuel can be prevented from being damaged by heat while being delivered from the supply pump unit to the high-pressure pump unit, making it possible to further reliably suppress vaporization of the fuel being supplied to the high-pressure pump unit (claim 3).

In the high-pressure fuel pump device, the fuel return unit is constituted by the return path and the return valve, so that the fuel return unit can be simplified in structure (claim 4).

The drive source for driving the plunger is separated by the diaphragm from the pump section where the fuel passes, and it is therefore possible to prevent the fuel from leaking into the drive source (claim 5).

DESCRIPTION OF EMBODIMENTS

A first embodiment of the present invention will be described below with reference to FIGS. 1 to 6.

Figure 1:
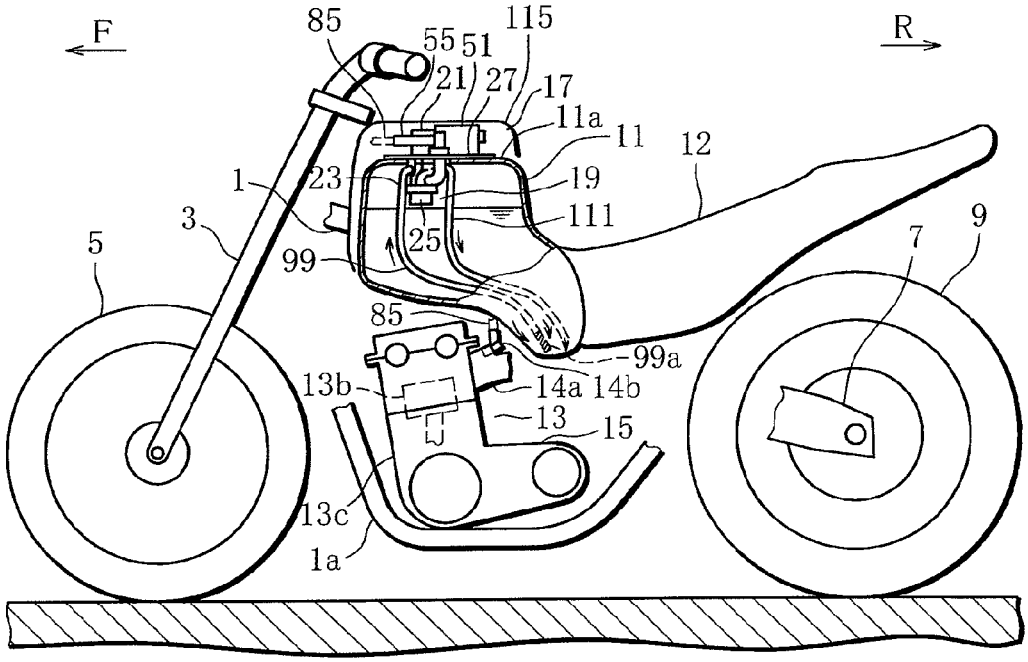
FIG. 1 is a side view illustrating a high-pressure fuel pump device according to a first embodiment of the present invention, together with a motorcycle on which the fuel pump device is mounted.

FIG. 1 is a schematic side view of a motorcycle on which a high-pressure fuel pump device according to the present invention is mounted. In FIG. 1, an arrow F indicates the forward direction of the motorcycle, and an arrow R indicates the rearward direction of the motorcycle.

The motorcycle illustrated in FIG. 1 has a main frame member extending in a longitudinal direction thereof, for example, a main tube member 1 (only part of which is shown). A front wheel 5 is supported by a frontal end portion of the main tube member 1 through a front fork 3 (having a telescopic structure built therein), and a rear wheel 9 is supported by a rear end portion of the main tube member 1 through a swing arm member 7.

A fuel tank 11 and a seat 12 are placed on the main tube member 1 in the mentioned order from front to back. An acceleration/deceleration system including a brake pedal and a throttle grip (neither of which is shown) is provided on the right side of the main tube member 1, and a gearshift system including a clutch lever and a shift pedal (neither of which is shown) is provided on the left side of the main tube member 1.

The main tube member 1 includes a down tube member 1*a* extending downward therefrom. An engine, for example, a single-cylinder reciprocating engine 13 (hereinafter merely referred to as the engine 13) having a piston 13*b* fitted into a cylinder (not shown) for reciprocating motion, is placed in a space enclosed by the down tube member 1*a* and the fuel tank 11 (including the main tube member 1).

An injector 14*b* is inserted in an intake pipe 14*a* (communicating with the cylinder) of the engine 13 and capable of injecting fuel into the intake pipe 14*a* (or the cylinder). Although not illustrated, the injector 14*b* is connected to a control unit (not shown) including a microcomputer and other related elements so that fuel injection quantity and fuel injection timing may be controlled in accordance with the operating condition of the engine 13 (electronically controlled fuel injection mechanism).

A transmission 15 having a clutch mechanism (not shown) built therein is attached to a crankcase 13*c* of the engine 13. The output of the transmission 15 is connected to the rear wheel 9 through a power transmission member, for example, an endless chain member, not shown. Thus, the motorcycle is configured such that the rear wheel 9 is driven by the driving force generated by the engine 13.

A fuel supply system for supplying fuel to the injector 14*b* employs a high-pressure fuel pump device 17, which constitutes a central part of the present invention. The high-pressure fuel pump device 17, which has a fuel drawing function, draws up (sucks in) the fuel stored in the fuel tank 11, raises the fuel pressure, and supplies the high-pressure fuel to the injector 14*b*. The high-pressure fuel pump device 17 has a configuration such that, at which location around the fuel tank 11 or the engine 13 it is installed, the high-pressure fuel pump device 17 can stably suck in the fuel stored in the fuel tank 11 and supply the fuel from the installed location to the injector 14*b*. FIG. 1 illustrates an exemplary case where the high-pressure fuel pump device 17 is attached to an upper wall 11*a* of the fuel tank 11.

Figure 2:
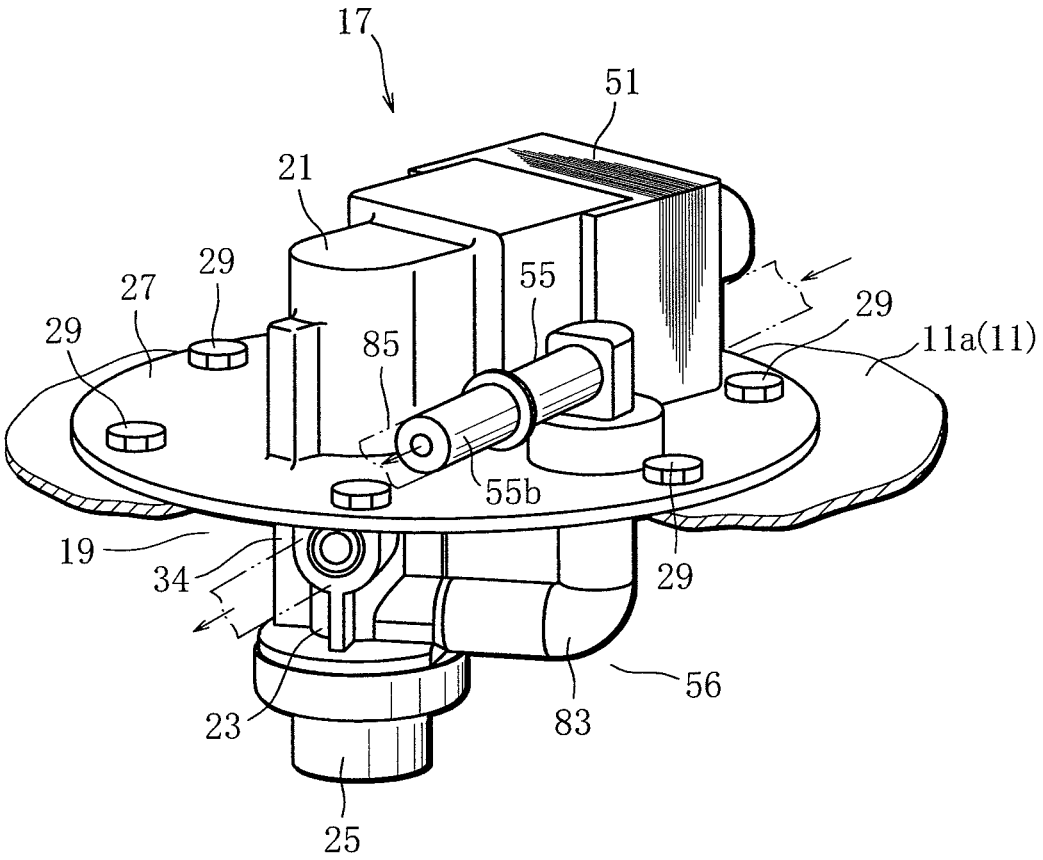
FIG. 2 is a perspective view illustrating an external appearance of the high-pressure fuel pump device.
Figure 3:
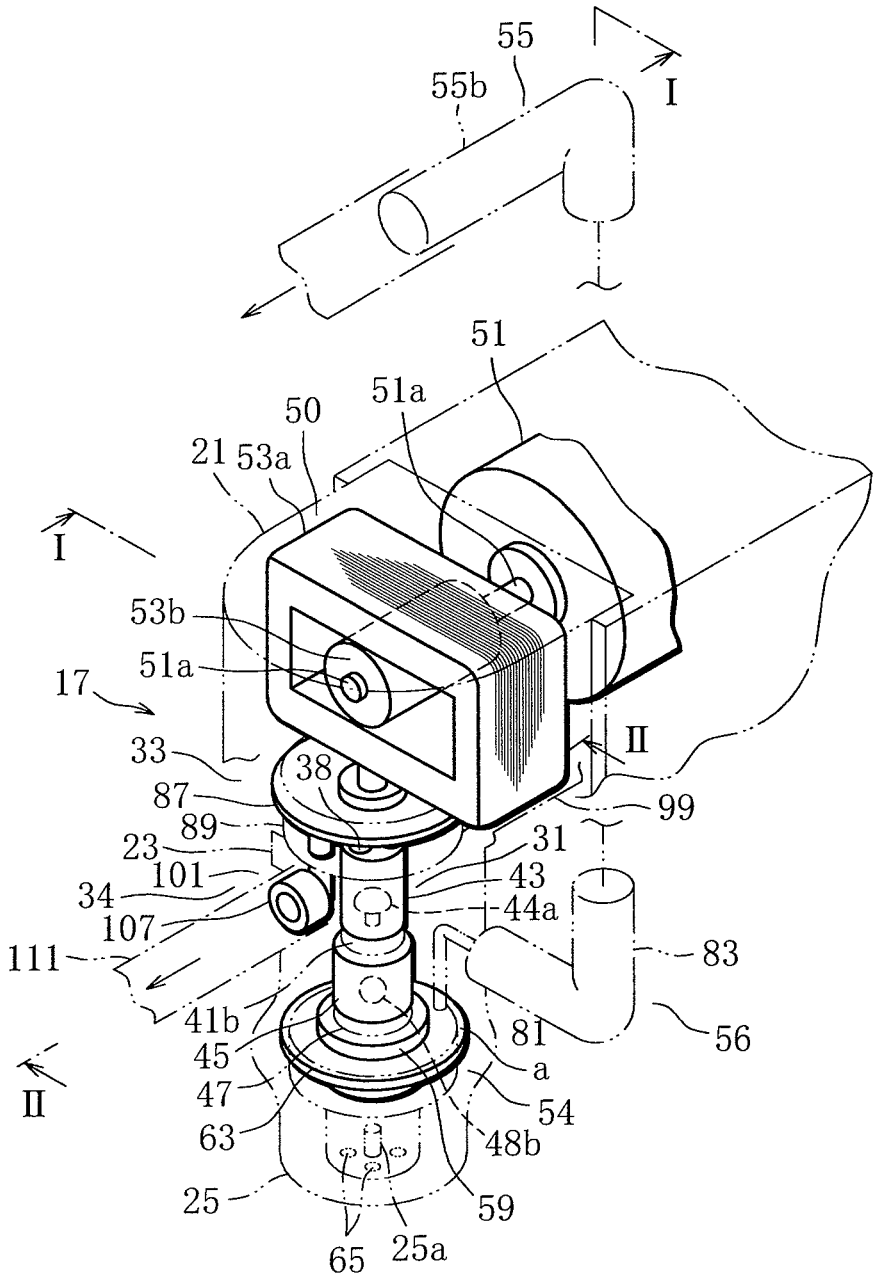
FIG. 3 is a perspective view illustrating an internal configuration of the high-pressure fuel pump device.
Figure 4:
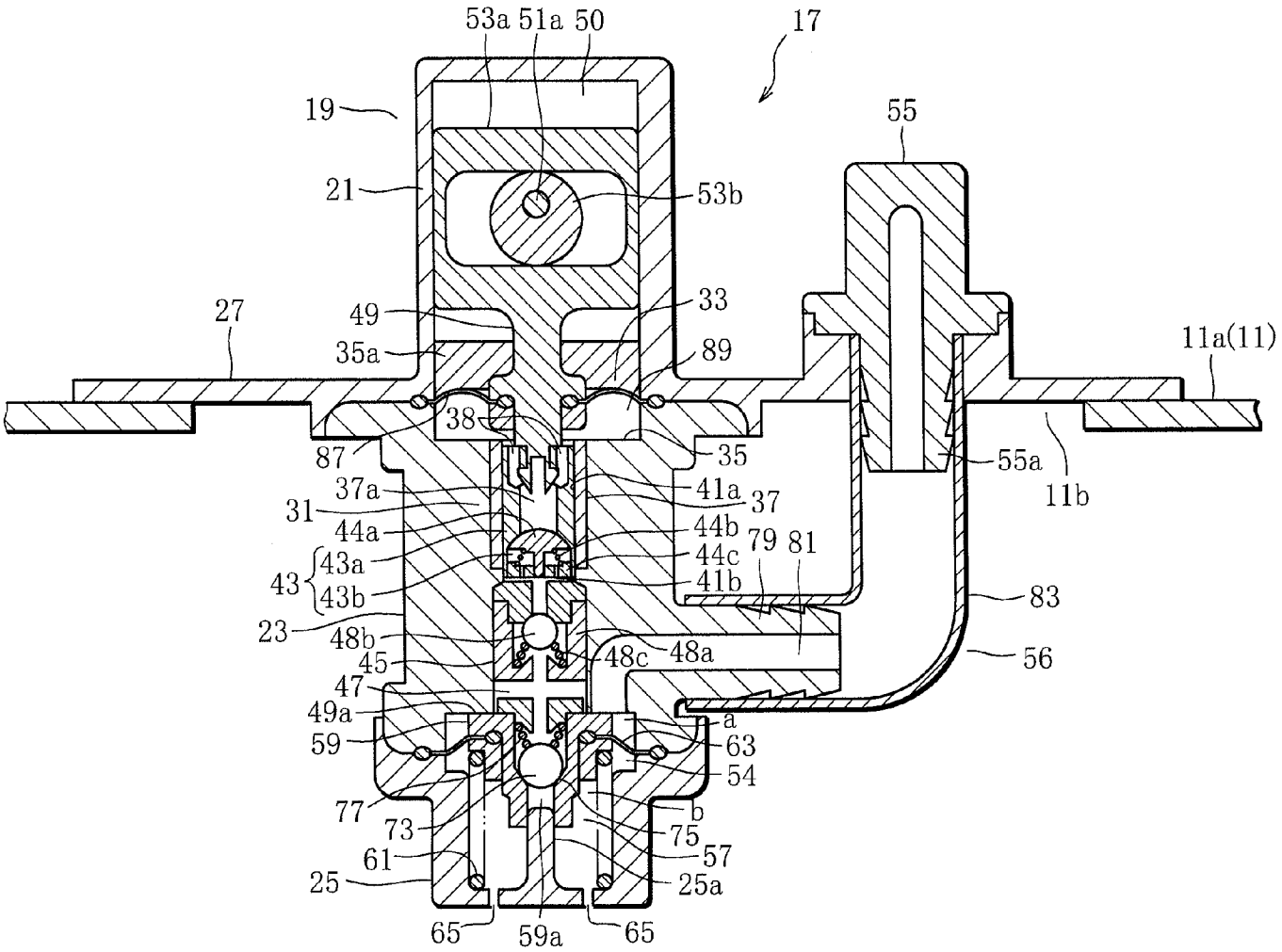
FIG. 4 is a sectional view of the high-pressure fuel pump device, taken along line A-A in FIG. 3.
Figure 5:
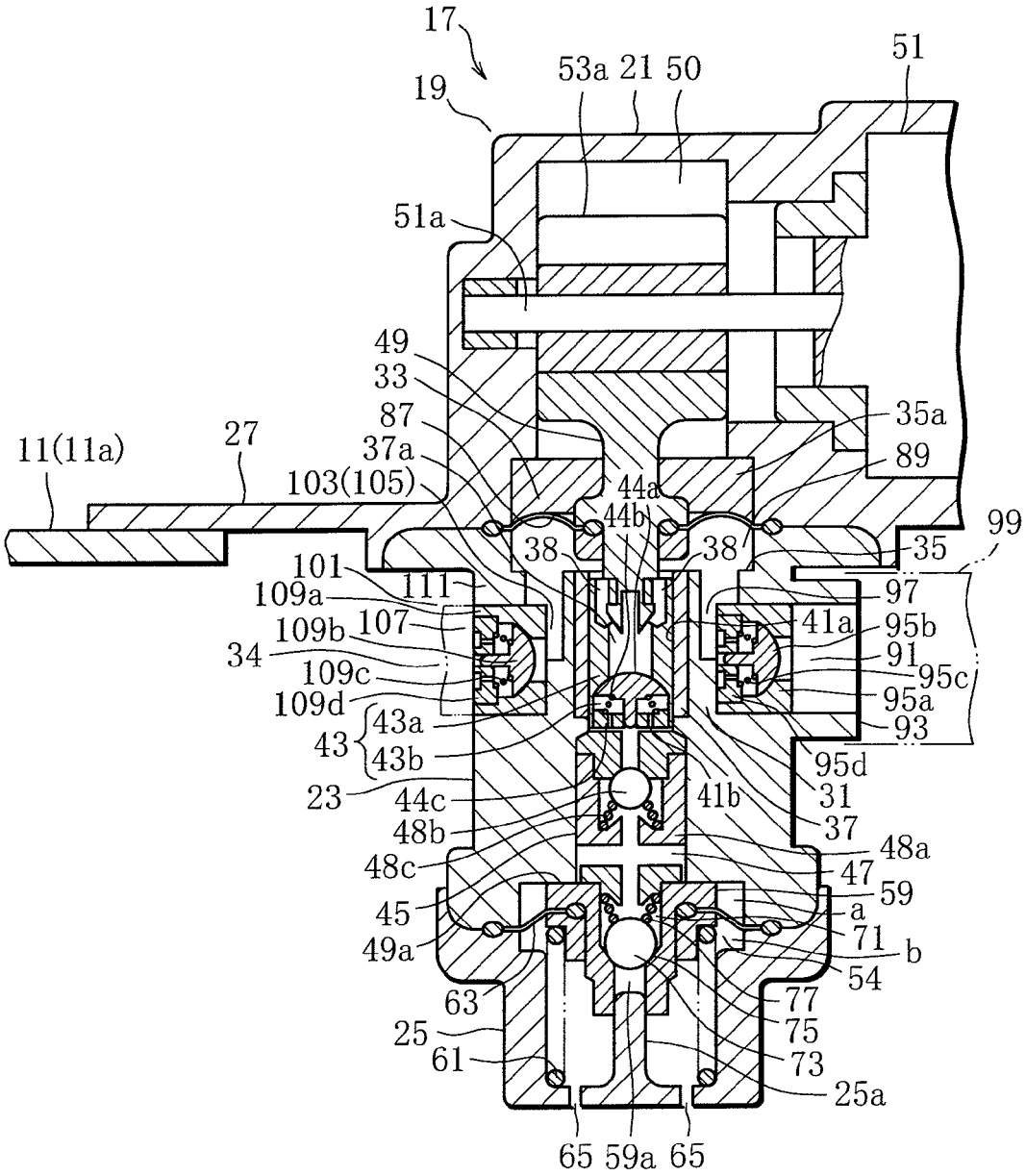
FIG. 5 is a sectional view of the high-pressure fuel pump device, taken along line B-B in FIG. 3.

FIG. 2 is a perspective view illustrating an external appearance of the high-pressure fuel pump device 17 attached to the upper wall 11*a*, and FIG. 3 is a perspective view schematically illustrating an internal configuration of the high-pressure fuel pump device 17. FIGS. 4 and 5 illustrate sections respectively indicated in FIG. 3 (as viewed from the directions indicated by arrows I-I and II-II, respectively).

Referring to FIGS. 2 to 5, the configuration of the high-pressure fuel pump device 17 will be explained. In the figures, reference sign 19 denotes a body of the fuel pump device 17. The body 19 has a vertically elongated structure constituted, for example, by an upper case 21 in the form of a box opening at a bottom and one side thereof, a lower case 23 in the form of a short cylinder coupled to a lower end of the upper case 21, and a bottomed cover 25 coupled to a lower end of the lower case 23. A disc-shaped mounting plate 27 serving as an attaching portion protrudes outward from a part of the body 19, for example, from the opening edge of the upper case 21. Using the mounting plate 27, the body 19 is attached to the upper wall 11*a* of the fuel tank 11.

The body 19 is fixed to the fuel tank 11 in such a manner that, with the cover 25 and the lower case 23 inserted into a pump device-mounting hole 11*b* (shown in FIG. 4 only) formed through the upper wall 11*a* of the fuel tank 11, the mounting plate 27 is placed on an edge portion around the mounting hole 11*b* and fastened to the upper wall 11*a* by means of fastening members, such as bolt members 29 (shown in FIG. 2 only).

The lower case 23, which is located inside the fuel tank 11, has incorporated therein a plunger-type high-pressure pump unit 31 for raising the pressure of the fuel, a diaphragm-type supply pump unit 33 for drawing up the fuel stored in the fuel tank 11, and a fuel return unit 34 for returning surplus fuel from the supply pump unit 33, as shown in FIGS. 3 to 5. A discharge port for discharging the pressurized fuel, in this embodiment, an L-shaped discharge port 55 illustrated in FIGS. 1 to 4 is connected to an upper end of the cover 25.

The lower case 23 has a hollow formed therein, and an upper end portion of the hollow is constituted by a recess 35 having a larger diameter than the rest of the hollow. The high-pressure pump unit 31 is fitted into the hollow extending downward from the recess 35.

The high-pressure pump unit 31 will be explained in more detail. As illustrated in FIGS. 4 and 5, a tubular sleeve member 37, for example, is press-fitted into the hollow from an upper through to an intermediate portion thereof. The sleeve member 37 defines a plunger accommodation chamber 41*a* therein. Also, a pressurizing chamber 41*b* is defined immediately beneath the lower end of the sleeve member 37.

As shown in FIGS. 3 to 5, a plunger 43 provided with a suction valve is fitted in the plunger accommodation chamber 41*a* for reciprocating motion. A discharge valve 45 is arranged in a portion of the hollow immediately beneath the pressurizing chamber 41*b*. The plunger 43 includes a tubular plunger body 43*a* arranged in the plunger accommodation chamber 41*a*, and a suction valve 43*b* incorporated into a lower end portion (distal end portion) of the plunger body 43*a*. Specifically, the suction valve 43*b* is constituted by a check valve which opens and closes the lower end of the hollow in the plunger body 43*a* and which permits fuel to flow only in a direction from within the plunger body 43*a* to the pressurizing chamber 41*b*. For example, the suction valve 43*b* is constituted by a check valve which is configured such that a mushroom valve element 44*a* is accommodated, together with a valve spring 44*b*, in the lower end portion of the hollow in the plunger body 43*a* and is supported by the valve spring 44*b* and a valve guide 44*c* having through holes.

A high-pressure chamber 47 constituted by the hollow is formed in the lower part of the lower case 23. The discharge valve 45 is situated between the high-pressure chamber 47 and the pressurizing chamber 41*b*. The discharge valve 45 is constituted by a check valve which permits fuel to flow only in a direction from the pressurizing chamber 41*b* toward the high-pressure chamber 47. For example, the discharge valve 45 is constituted by a check valve module having a ball valve element 48*b* and a valve spring 48*c* accommodated in a tubular valve chamber unit 48*a*.

As illustrated in FIGS. 4 and 5, a columnar transmission member (actuator shaft) 49 is coupled to the upper end portion of the plunger body 43*a* coaxially with the plunger 43. The transmission member 49 penetrates through the recess 35 and a guide member 35*a* located immediately above the recess 35, and extends in a straight line into the upper case 21. An upper end portion of the transmission member 49 is connected, via a reciprocating motion conversion mechanism, in this embodiment, a cam mechanism 50, to a drive source fitted to the open side of the upper case 21, in this embodiment, a DC motor 51 (hereinafter merely referred to as the motor 51). Thus, the transmission member 49 is driven by rotation of the motor 51 to reciprocate the plunger 43.

Specifically, as shown in FIG. 3 by way of example, a conversion mechanism having a rectangular cam receiving frame 53*a* located over the upper end of the plunger 43 and an eccentric cam 53*b* received in the cam receiving frame 53*a* is used as the cam mechanism 50. The eccentric cam 53*b* is coupled at its center of rotation to an output shaft 51*a* of the motor 51. Thus, the cam mechanism 50 converts eccentric rotary motion of the eccentric cam 53*b* driven by the motor 51 to linear reciprocating motion by means of the cam receiving frame 53*a*, the linear reciprocating motion being transmitted to the plunger body 43*a* through the transmission member 49, so that the plunger 43 makes reciprocating motion in a vertical direction.

The high-pressure pump unit 31 is configured to pressurize fuel in the pressurizing chamber 41*b* and discharge the pressurized fuel to the high-pressure chamber 47, by making use of the reciprocating motion of the plunger 43, more particularly, by the action of the suction and discharge valves 43*b* and 45 that open and close in conjunction with the movement of the plunger 43.

As shown in FIGS. 3 and 4, the high-pressure chamber 47 communicates with the discharge port 55 through a regulator 54, which is arranged at the lowermost part of the lower case 23, and an interconnection pipe 56.

In connection with the regulator 54, reference sign 57 denotes a valve accommodation chamber extending from the boundary between the lower case 23 and the cover 25 to the bottom of the cover 25. The valve accommodation chamber 57 is a cylindrical space concentric with the high-pressure chamber 47. A tubular valve element 59 is accommodated in that portion of the valve accommodation chamber 57 which is located on the same side as the high-pressure chamber 47. The valve element 59 is configured to rest on a valve seat 49*a*, which is the opening edge of the high-pressure chamber 47, and is vertically displaceable along a pin 25*a*, as a guide, which protrudes from the inner bottom surface of the cover 25. Also, the valve element 59 is urged in the valve closing direction (the direction in which the valve element comes into close contact with the valve seat) by a valve spring 61 disposed in the cover 25. The space around the valve element 59 is divided by a diaphragm 63 extending from the boundary between the lower case 23 and the cover 25 to the outer peripheral surface of the valve element 59. Out of the divided spaces, the space a located on the same side as the high-pressure chamber 47 serves as a pressure regulating chamber. Communication passages, not shown, are formed in the valve element 59 so as to always communicate with the space a.

The other space b divided by the diaphragm 63 and located on the same side as the bottom of the cover 25 opens into the fuel tank 11 (at atmospheric pressure) via through holes 65 formed in the bottom of the cover 25, as shown in FIGS. 4 and 5. When the fuel pressure in the high-pressure chamber 47 becomes higher than a fuel pressure determined by the valve spring 61, the valve element 59 moves away from the valve seat 49*a* of the high-pressure chamber 47, and a passage 82 (FIGS. 6C and 6D) communicates with the space a, whereby the fuel in the high-pressure chamber 47 is introduced into the space a through the passage 82.

As illustrated in FIGS. 4 and 5, a check valve 71 for relieving the high-pressure chamber 47 of excessively high fuel pressure is arranged within the valve element 59. The check valve 71 is a normally-closed type including, for example, a ball valve element 73 movably accommodated in a portion of a cavity 59*a* of the valve element 59 into which the pin 25*a* is inserted, a valve seat 75 which is formed near a portion of the cavity beneath the valve element 73 and with which the valve element 73 comes into and out of contact, and a valve spring 77 configured to urge the valve element 73 against the valve seat 75. The length of protrusion of the pin 25*a* is set so that the pin 25*a* abuts against the valve element 73 when the fuel pressure reaches a predetermined fuel pressure. Thus, when the fuel pressure in the high-pressure chamber 47 becomes excessively high, the pin 25*a* pushes the valve element 73 apart from the valve seat 75, thereby allowing the fuel with excessively high pressure to escape into the fuel tank 11 through the cavity 59*a*, the interior of the cover 25, and the through holes 65.

That is to say, the regulator 54 is configured to adjust the fuel pressure to a pressure suited for fuel injection through change of the opening of the valve element 59 in response to the fuel pressure and forced relief of the fuel pressure by the valve element 73. Needless to say, the regulator 54 serves also as an accumulator.

As shown in FIG. 4, the interconnection pipe 56 includes a mouthpiece 79 protruding from a lateral part of the lower case 23, a passage 81 connecting the space a divided by the diaphragm 63 to the interior of the mouthpiece 79, and a pipe member 83 connecting between the mouthpiece 79 and a mouthpiece 55*a* forming the inlet of the discharge port 55. A mouthpiece 55*b* (shown in FIG. 2), which forms the outlet of the discharge port 55, is connected, via a pipe member connected to the mouthpiece 55*b*, for example, via a high-pressure pipe 85, to the fuel inlet of the injector 14*b* as shown in FIG. 1, so that the high-pressure fuel pressurized by the high-pressure pump unit 31 can be supplied to the injector 14*b*.

On the other hand, the diaphragm-type supply pump unit 33 employs a pump mechanism which is driven by the common drive source (single motor 51) and in which a diaphragm 87 is oscillated in conjunction with the reciprocating motion of the plunger 43 shown in FIGS. 2 to 5. Specifically, the diaphragm 87 has an outer peripheral part sandwiched between the upper case 21 and the lower case 23 and an inner peripheral part held by the outer peripheral part of the transmission member 49, and is so arranged as to cover the opening of the recess 35. Accordingly, following the reciprocating motion of the transmission member 49, the diaphragm 87 oscillates up and down (in inward and outward directions with respect to the opening). Thus, a diaphragm chamber 89 whose capacity varies in response to the movement (oscillation) of the diaphragm 87 is defined in the recess 35. The lower surface of the guide member 35*a* located immediately above the diaphragm 87 serves as a receiving surface for the deformable diaphragm 87.

As shown in FIG. 5, the diaphragm chamber 89 communicates, via a suction valve 91, with a tubular suction port 93 formed on the peripheral wall of the lower case 23. Specifically, the suction valve 91, which is a check valve module having a mushroom valve element 95*b*, a valve spring 95*c* and a valve guide 95*d* incorporated in a valve body 95*a*, for example, is arranged in an internal passage of the suction port 93, and the outlet of the suction valve 91 and the bottom of the diaphragm chamber 89 are connected by a passage 97 formed in the peripheral wall of the lower case 23. A fuel hose 99 having a strainer 99*a* at a distal end thereof is connected to the suction port 93 (FIG. 1). As illustrated in FIG. 1, the fuel hose 99 is inserted into the fuel tank 11 such that the strainer 99*a* is located near the inner bottom surface of the fuel tank 11, and as the diaphragm 87 oscillates up and down, the fuel in the fuel tank 11 is sucked up by the pumping action (due to pressure difference) of the diaphragm chamber 89.

Also, as illustrated in FIGS. 4 and 5, the diaphragm chamber 89 communicates with the interior (hollow) of the plunger body 43*a* through a plurality of holes 38 formed at the joint between the plunger body 43*a* and the transmission member 49. Consequently, a passage 37*a* leading to the suction side of the high-pressure pump unit 31 is formed within the plunger body 43*a*. That is, the fuel sucked up by the diaphragm 87 is guided to the high-pressure pump unit 31 through the interior (passage 37*a*, suction valve 43*b*) of the plunger 43. The suction valve 43*b* in the plunger 43 serves also as a discharge valve of the diaphragm pump.

As shown in FIGS. 3 and 5, the fuel return unit 34, on the other hand, has a return port 101 formed in a peripheral wall portion of the lower case 23 opposite the suction port 93, for example. The return port 101 communicates with the diaphragm chamber 89 through a return path 105 and thus is able to receive surplus fuel remaining in the diaphragm chamber 89 after the fuel is sucked into the high-pressure pump unit 31. A return valve 107 is arranged in the return path 105, and the fuel remaining in the diaphragm chamber 89 can be guided to the return path 105 during discharging action of the diaphragm 87. In this manner, the supply pump unit 33 is provided with the fuel return mechanism.

Specifically, the return valve 107, which is, like the suction valve 91, a check valve module having a mushroom valve element 109*b*, a valve spring 109*c* and a valve guide 109*d* incorporated in a valve body 109*a*, is arranged in an internal passage of the return port 101, as shown in FIG. 5, and the inlet of the return valve 107 and the bottom of the diaphragm chamber 89 are connected by a passage 103 formed in the peripheral wall of the lower case 23. Namely, the return valve 107 is configured such that the fuel remaining in the diaphragm chamber 89, that is, out of the fuel supplied to the high-pressure pump unit 31, surplus fuel that is not sucked into the high-pressure pump unit 31, is guided to the return port 101 through the check valve by utilizing the pressure of the diaphragm chamber 89 which rises during discharging action of the diaphragm 87.

As shown in FIG. 1, a fuel hose 111 is connected to the return port 101 and returns the surplus fuel recovered via the return port 101 to the fuel tank 11.

In the high-pressure fuel pump device 17, the high-pressure pump unit 31 and the supply pump unit 33 are arranged on the lower side (one side) of the diaphragm 87 whereas the motor 51 is arranged on the opposite upper side (other side) of the diaphragm 87 such that the motor 51 (drive source) and the pump section in which fuel flows are separated by the diaphragm 87. In FIG. 1, reference sign 115 denotes a cover placed over the high-pressure fuel pump device 17 to conceal same.

Operation of the high-pressure fuel pump device 17 is illustrated in FIGS. 6A, 6B, 6C and 6D in order.

Referring to FIGS. 6A to 6D, the operation of the high-pressure fuel pump device 17 will be explained. Electric current is supplied to the motor 51, whereupon the motor 51 starts rotating. Rotation of the motor 51 is transmitted to the eccentric cam 53*b* through the output shaft 51*a*, and the eccentric cam 53*b* causes the cam receiving frame 53*a* to move up and down. Thus, rotary motion of the motor 51 is converted to linear reciprocating motion, which is transmitted to the transmission member 49 to cause the plunger 43 to reciprocate up and down, so that the diaphragm 87 oscillates vertically.

When the plunger 43 ascends, negative pressure is generated in the pressurizing chamber 41*b*. Negative pressure is generated also in the diaphragm chamber 89.

Figure 6A:
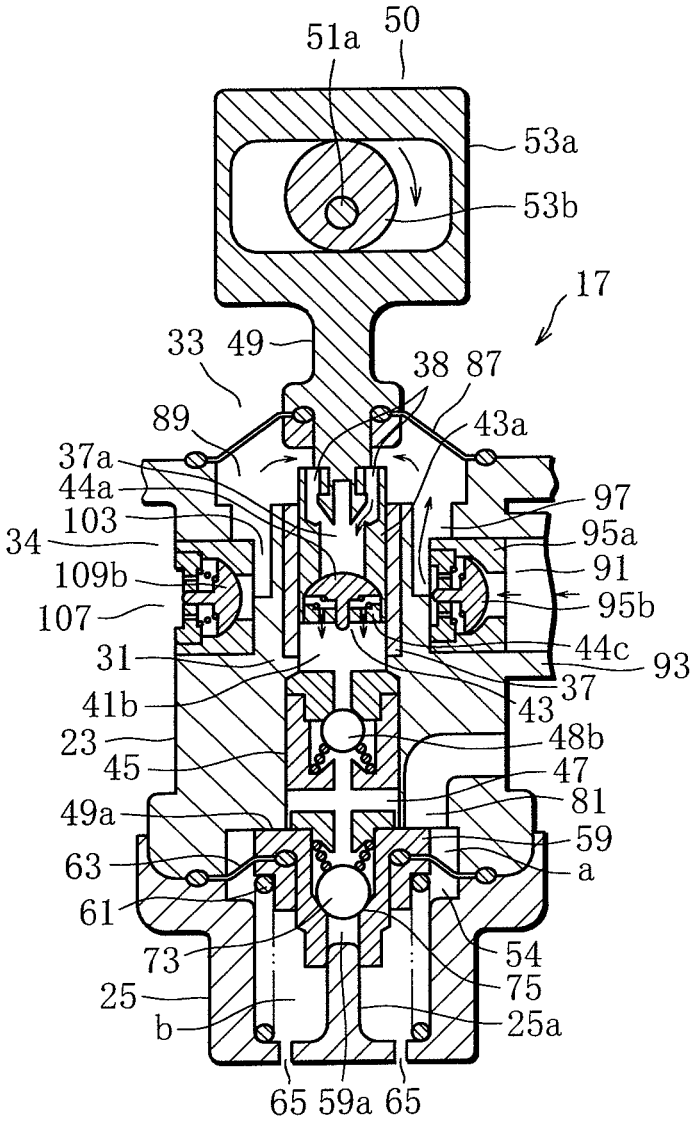
FIG. 6A is a sectional view illustrating operation of the high-pressure fuel pump device.

At this time, the suction valve 43*b* built into the plunger 43 and the suction valve 91 in the diaphragm chamber 89 are both opened (return valve 107 is closed), as shown in FIG. 6A. Accordingly, the fuel in the diaphragm chamber 89 is sucked into the pressurizing chamber 41*b* through the suction valve 43*b*, as indicated by arrows showing the fuel flow in FIG. 6A. Simultaneously, the fuel in the fuel tank 11 is sucked into the diaphragm chamber 89 from the fuel hose 99 through the suction port 93 and the suction valve 91. Namely, suction operation is performed. Consequently, an amount of fuel corresponding to the amplitude of oscillation of the diaphragm 87 plus an amount of fuel sucked into the pressurizing chamber 41*b* are drawn up from the fuel tank 11 (suction stroke).

The supply pump unit 33 and the high-pressure pump unit 31 are located close to each other, and therefore, heat damage to the fuel can be minimized even if the fuel is subjected to heat from outside.

Figure 6B:
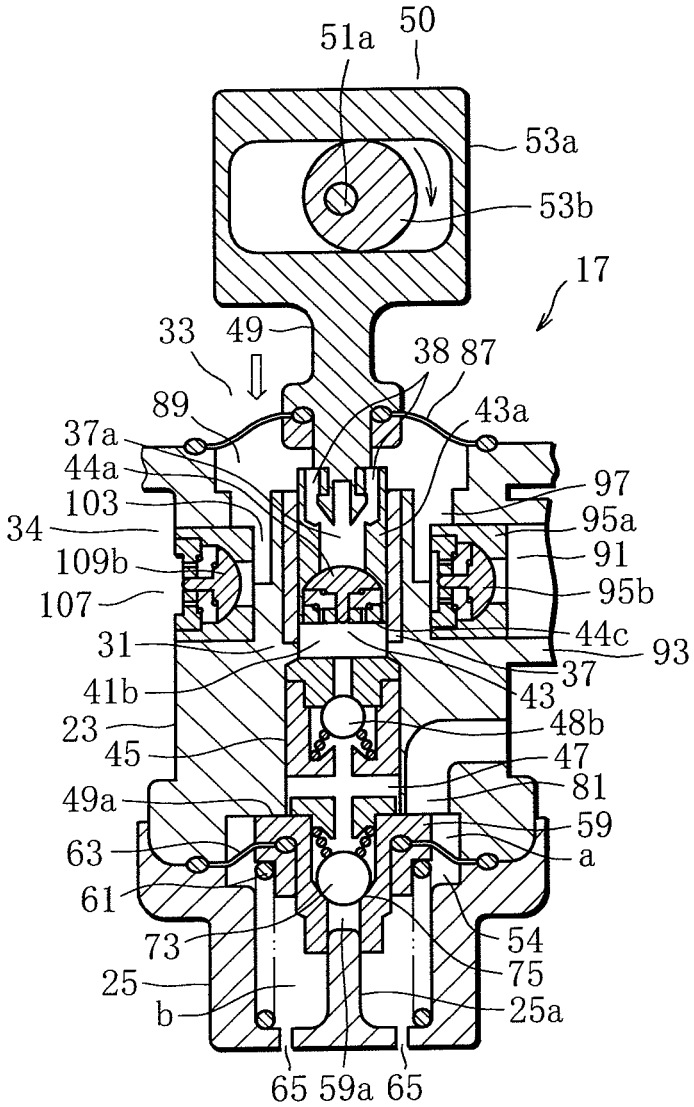
FIG. 6B is a sectional view illustrating the operation of the high-pressure fuel pump device.

Subsequently, the plunger 43 begins to descend, whereupon the suction valve 43*b* built into the plunger 43 closes, as shown in FIG. 6B, and starts to pressurize the fuel in the pressurizing chamber 41*b* (pressurization stroke). At the same time, the pressure in the diaphragm chamber 89 is increased by the diaphragm 87 descending together with the plunger 43. As a result, the suction valve 91 is closed.

Figure 6C:
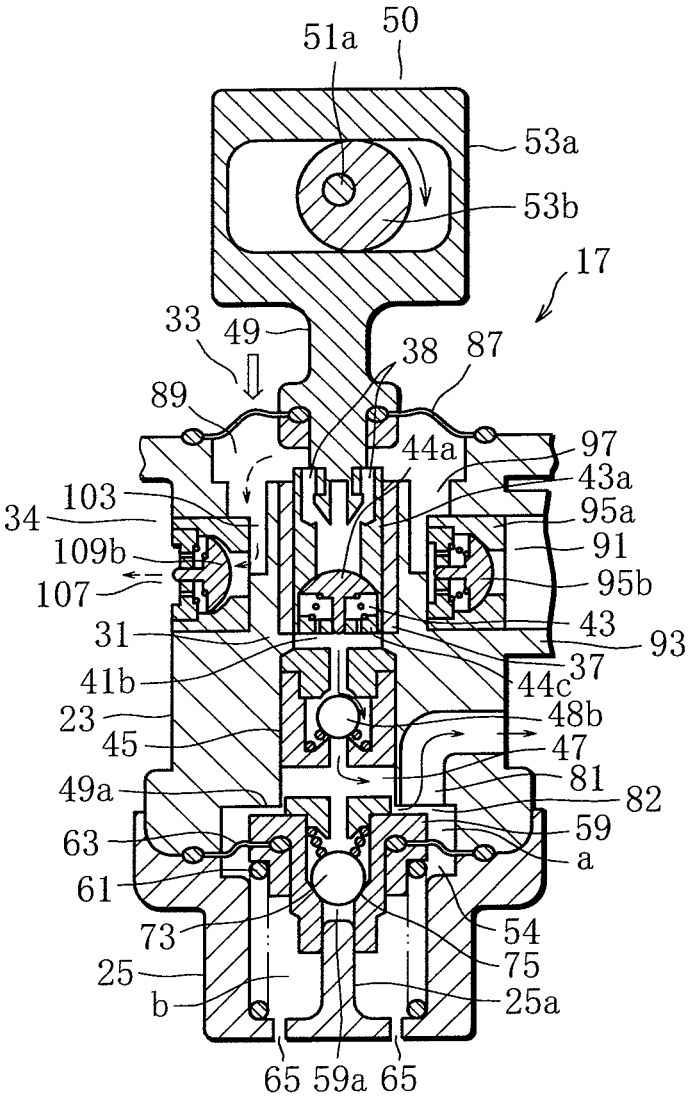
FIG. 6C is a sectional view illustrating the operation of the high-pressure fuel pump device.

The plunger 43 descends further, and when the fuel pressure in the pressurizing chamber 41*b* exceeds the valve-opening pressure set by the valve spring 48*c* of the discharge valve 45, the discharge valve 45 opens, as shown in FIG. 6C, and the pressurized fuel is discharged to the high-pressure chamber 47 (discharge stroke). Simultaneously with this, the pressure in the diaphragm chamber 89 also rises as the plunger 43 descends. When the pressure in the diaphragm chamber 89 exceeds the valve-opening pressure set by the return valve 107, the return valve 107 opens, and the fuel remaining in the diaphragm chamber 89, that is, surplus fuel that is not sucked into the pressurizing chamber 41*b*, is returned from the return port 101 to the fuel tank 11 through the fuel hose 111.

Even if the fuel in the diaphragm chamber 89 contains vapor because of heat from the engine 13 or the like, such vapor is returned to the fuel tank 11 together with the recovered fuel (return fuel), whereby the fuel supply from the diaphragm chamber 89 to the high-pressure chamber 47 can be continued in a stable manner.

The fuel in the high-pressure chamber 47 is introduced at all times into the space a via the communication passages, not shown, formed in the valve element 59, and with the fuel pressure in the space a adjusted by the pressure regulating function of the diaphragm 63, the fuel is supplied from the space a to the discharge port 55 through the passage 81 and the pipe member 83 and then to the injector 14*b* via the high-pressure pipe 85. When the fuel pressure in the high-pressure chamber 47 reaches a predetermined pressure, the valve element 59 of the regulator 54 moves away from the valve seat 49*a*, as shown in FIGS. 6C and 6D, and the passage 82 is connected to the space a, as indicated by arrows in FIGS. 6C and 6D, with the result that the fuel accumulated in the high-pressure chamber 47 is supplied to the injector 14*b* through the passages 82 and 81, the pipe member 83, the discharge port 55 and the high-pressure pipe 85.

Figure 6D:
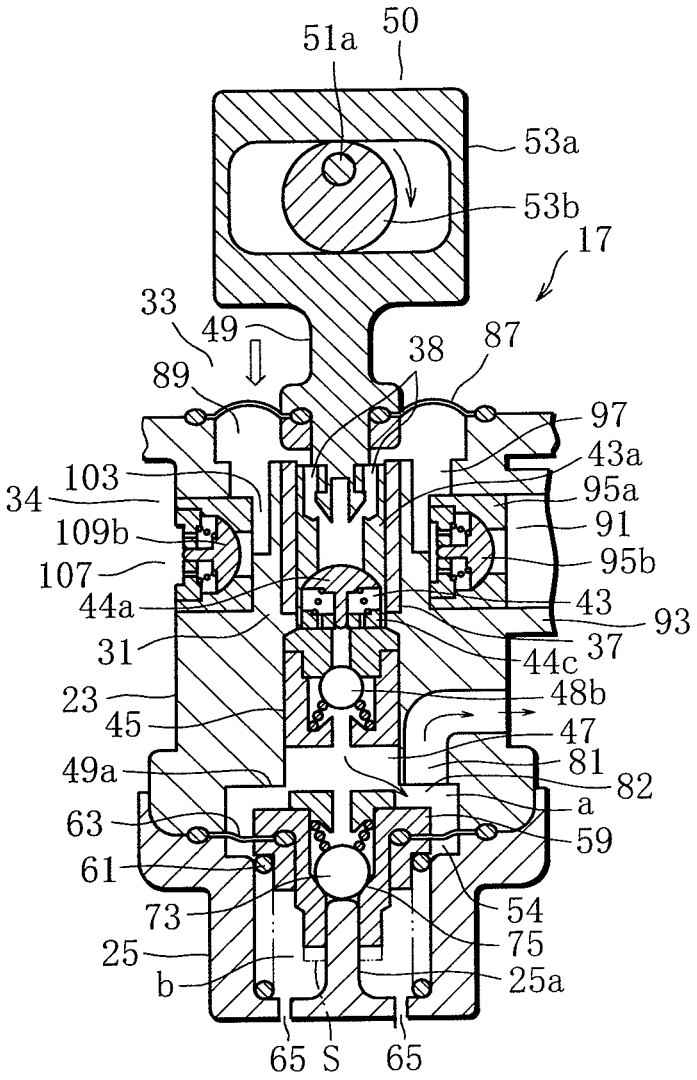
FIG. 6D is a sectional view illustrating the operation of the high-pressure fuel pump device.

When the fuel pressure in the high-pressure chamber 47 becomes excessively high, the valve element 59 descends to an extent such that the pin 25*a* abuts against the valve element 73, as indicated by two-dot chain lines S in FIG. 6D, and causes the valve element 73 to leave (move away from) the valve seat 75, to allow the fuel with excessively high pressure to escape to the fuel tank 11, thereby keeping the fuel pressure at a pressure suited for fuel injection.

Consequently, the high-pressure fuel pump device 17 can stably perform a series of operations from the suction of fuel from the fuel tank 11 through to the supply of high-pressure fuel to the injector 14*b*. In particular, the high-pressure fuel pump device 17 has a compact structure in which the high-pressure pump unit 31 and the supply pump unit 33 are integrated and share the single motor 51 as a drive source with the transmission member 49 and the plunger 43 coaxially arranged, a heat damage resistant structure in which the high-pressure pump unit 31 and the supply pump unit 33 are located close to each other to suppress heat damage, and a return structure for returning surplus fuel as well as vapor contained in the fuel to the fuel tank 11, whereby reduction in the number of component parts, reduction in cost, space efficiency and enhanced outfitting flexibility can be realized by a single device. Also, the supply pump unit 33 is provided to draw up fuel stored in the fuel tank 11, and accordingly, even while the amount of fuel remaining in the fuel tank 11 is small, the fuel can be reliably drawn up from the bottom of the fuel tank 11 and supplied to the injector 14*b*.

Figure 7:
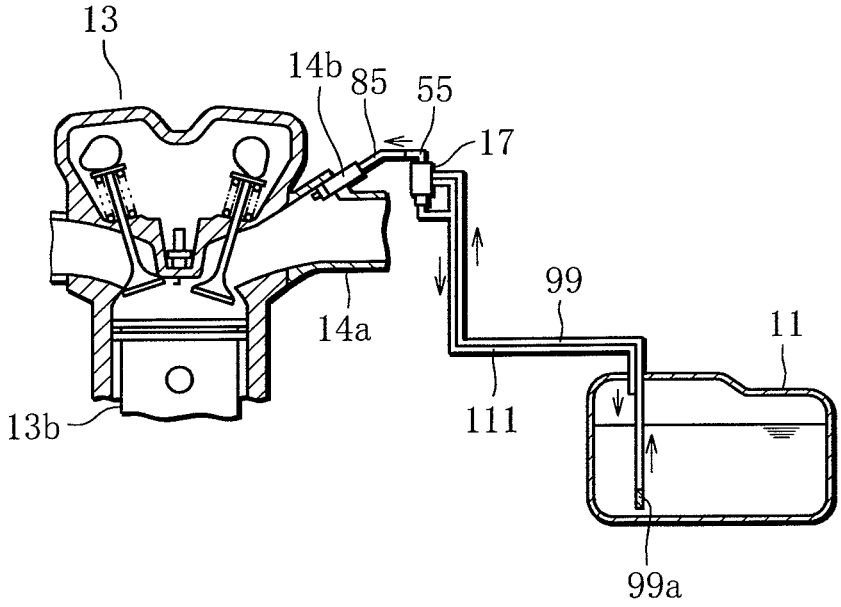
FIG. 7 illustrates a principal part of a second embodiment of the present invention.

Since low-pressure fuel and fuel vapor, which is liable to be generated in the supply pump unit 33, are returned together with surplus fuel from the diaphragm chamber 89 to the fuel tank 11 by the fuel return unit 34, the high-pressure fuel pump device 17 can be installed at a desired location of a motorcycle with many constraints, regardless of the generation of vapor. For example, as shown in FIG. 7 illustrating a second embodiment, the high-pressure fuel pump device 17 may be installed in a region close to the injector 14*b* of the engine 13 where the fuel is easily affected by heat from the engine 13 (where fuel vapor is most likely to be generated), instead of the upper part of the fuel tank 11 as illustrated in FIGS. 1 to 6. Thus, the high-pressure fuel pump device 17, in combination with its compact structure sharing the drive source, ensures enhanced outfitting flexibility and is suited for use in motorcycles. In FIG. 7, like reference signs refer to like component parts appearing in FIGS. 1 to 6, and description of the component parts is omitted.

Also, the supply pump unit 33 employs such a configuration that the fuel is guided to the high-pressure pump unit 31 via the internal passage 37*a* formed in the plunger 43, and accordingly, the fuel is less affected by external heat such as heat from the engine 13. It is therefore possible to prevent the fuel from being thermally damaged while flowing from the supply pump unit 33 to the high-pressure pump unit 31, and also to suppress generation of vapor from the fuel being supplied to the high-pressure pump unit 31.

The fuel return unit 34, in particular, can be simplified in structure because it uses only the return path 105 for receiving the fuel to be returned and the return valve 107 for letting the fuel out of the diaphragm chamber 89.

Further, in the high-pressure fuel pump device 17, the motor 51 (drive source) is arranged on one side of the diaphragm 87, and the high-pressure pump unit 31 and the supply pump unit 33 are arranged on the opposite side of the diaphragm 87. Since the motor 51 is separated from the pump section in which the fuel flows, it is possible to avoid damage to the motor 51 due to the fuel.

The present invention is not limited to the foregoing embodiments and may be modified in various ways without departing from the scope of the invention.

For example, in the above embodiments, the high-pressure fuel pump device is installed at the upper part of the fuel tank or in the vicinity of the injector. The location where the high-pressure fuel pump device is to be installed is not limited to such locations, and the fuel pump device may be installed at some other location.

Also, the reciprocating motion of the plunger may of course be attained by some other conversion mechanism than the one using the cam mechanism and the motor.

Further, the high-pressure fuel pump device of the present invention may be applied to other motor vehicles than motorcycles, such as automobiles.

REFERENCE SIGNS LIST

11: fuel tank
13: engine
14*b*: injector
17: high-pressure fuel pump device
19: body
31: high-pressure pump unit
33: supply pump unit
34: fuel return unit
37*a*: passage
43: plunger
49: transmission member (actuator shaft)
51: motor (drive source)
87: diaphragm
89: diaphragm chamber
105: return path
107: return valve

The invention claimed is:

1. A high-pressure fuel pump device comprising:

a plunger-type high-pressure pump unit including a plunger driven by a drive source, the high-pressure pump unit being configured to pressurize fuel and discharge the pressurized fuel as the plunger makes reciprocating motion;

a diaphragm-type supply pump unit including a diaphragm capable of oscillating in conjunction with the reciprocating motion of the plunger, and a suction valve capable of sucking in fuel in a fuel tank, the supply pump unit being configured to supply the fuel to the high-pressure pump unit as the diaphragm oscillates; and a fuel return unit provided in the supply pump unit and configured such that, out of the fuel supplied to the high-pressure pump unit, surplus fuel that is not sucked into the high-pressure pump unit is returned to the fuel tank by the fuel return unit, wherein the plunger of the high-pressure pump unit has a passage formed therein, and wherein the supply pump unit is configured to guide the fuel to the high-pressure pump unit through the passage.

2. The high-pressure fuel pump device according to claim 1, wherein:

the diaphragm of the supply pump unit is coupled to the drive source through an actuator shaft, and the plunger of the high-pressure pump unit and the actuator shaft of the diaphragm are arranged coaxially with each other.

3. The high-pressure fuel pump device according to claim 1, wherein the fuel return unit includes a return path configured to pass the fuel to be returned, and a return valve arranged in the return path and configured to flow surplus fuel that is not sucked into the high-pressure pump unit.

4. The high-pressure fuel pump device according to claim 1, wherein:

the high-pressure pump unit and the suction valve and the fuel return unit of the supply pump unit are arranged on one side of the diaphragm, and the drive source is arranged on an opposite side of the diaphragm.

5. The high-pressure fuel pump device according to claim 2, wherein the fuel return unit includes a return path configured to pass the fuel to be returned, and a return valve arranged in the return path and configured to flow surplus fuel that is not sucked into the high-pressure pump unit.

6. The high-pressure fuel pump device according to claim 2, wherein:

the high-pressure pump unit and the suction valve and the fuel return unit of the supply pump unit are arranged on one side of the diaphragm, and the drive source is arranged on an opposite side of the diaphragm.

7. The high-pressure fuel pump device according to claim 3, wherein:

the high-pressure pump unit and the suction valve and the fuel return unit of the supply pump unit are arranged on one side of the diaphragm, and the drive source is arranged on an opposite side of the diaphragm.

* * * * *